United States Patent [19]

Murata

[11] Patent Number: 4,642,433

[45] Date of Patent: Feb. 10, 1987

[54] PUSHBUTTON SWITCH WITH AURAL CONFIRMATION OF OPERATION

[75] Inventor: Taneo Murata, Iwaki, Japan

[73] Assignee: Alps Electric Co., Ltd., Japan

[21] Appl. No.: 754,337

[22] Filed: Jul. 11, 1985

[30] Foreign Application Priority Data

Jul. 11, 1984 [JP] Japan ..... 59-104986[U]
Jul. 16, 1984 [JP] Japan ..... 59-107372[U]

[51] Int. Cl.[4] ..... H01H 5/18; H01H 9/16; H01H 13/36

[52] U.S. Cl. ..... 200/308; 200/159 A; 200/159 R; 200/340; 200/5 A; 200/67 DA

[58] Field of Search ..... 200/340, 308, 67 D, 200/67 DA, 67 DB, 159 R, 159 A, 159 B, 5 A

[56] References Cited

U.S. PATENT DOCUMENTS 3,829,632 8/1974 Klehm, Jr. ..... 200/5 A
3,969,600 7/1976 Sims, Jr. ..... 200/159 B
3,976,899 8/1976 Fanshowe ..... 340/365 E X
3,993,884 11/1976 Kondur et al. ..... 200/295
4,153,829 5/1979 Murata ..... 200/340
4,186,290 1/1980 Matsuo ..... 200/159 A
4,299,055 2/1981 Matsuo ..... 200/159 B
4,447,681 5/1984 Desmarais ..... 200/5 A
4,450,331 5/1984 Fukukura ..... 200/160

*Primary Examiner*—James E. Bryant, III
*Assistant Examiner*—Ernest G. Cusick
*Attorney, Agent, or Firm*—Guy W. Shoup

[57] ABSTRACT

A pushbutton switch for use in a keyboard incorporated in an electronic typewriter, work processor, or the like gives a tactile feel to the finger of the operator corresponding to a clicking operation and, at the same time, produces a clicking sound. The switch comprises a casing, a switching device in the casing, a stem, and a leaf spring. This spring has an upright portion and a bent portion. The leaf spring is so mounted in the casing that when the stem is depressed, the bent portion is reciprocated. This causes the upright portion to collide with the inner surface of one side wall of the casing, thus producing a clicking sound.

2 Claims, 9 Drawing Figures

PUSHBUTTON SWITCH WITH AURAL CONFIRMATION OF OPERATION

FIELD OF THE INVENTION

The present invention relates to a pushbutton switch for use in a keyboard incorporated in an electronic typewriter, word processor, terminal equipment, or the like and, more particularly, to a pushbutton switch which, when operated, makes a clicking sound and allows the human operator to sense the operation through her tactile sensation.

BACKGROUND OF THE INVENTION

It is desired from the viewpoint of human engineering that a tactile feedback be provided in connection with pushbutton switches for use in a keyboard. Specifically, when a switch is depressed, it is actuated and, at the same time, the operator should be allowed to sense the actuation through her tactile sensation. This will permit her to recognize that the switch has been actuated, which means that she is no longer required to keep depressing the switch. Accordingly, the keyboard is easy for the operator to operate, and gives less feeling of fatigue. Pushbutton switches of this kind are disclosed in U.S. Pat. Nos. 3,829,632, 3,993,884, and 4,153,829, where a snap-action leaf spring is used to give the operator a tactile feel when a switch is depressed. Since it is desired to make the tactile feedback more certain, there is a need for a keyboard which can not only give the operator a tactile feel but also produce a clicking sound when a switch is operated. However, the prior art devices described above are simply able to give a tactile feel, and it has been difficult for them to make a clicking sound.

SUMMARY OF THE INVENTION

It is the main object of the present invention to provide a pushbutton switch which is excellent from the viewpoint of human engineering in that it can not only give a tactile feel but also produce a clicking sound within the switch casing when the switch is actuated.

The above and additional objects are achieved by a pushbutton switch comprising: a casing; a pushbutton stem; a leaf spring having an upright portion that bears on the inner surface of a side wall of the casing, a bent portion extending from the upright portion at an angle, a spring portion extending downwardly from the bent portion toward the stem to produce a clicking operation, and protruding portions formed at the front end of the spring portion; and wherein when the stem presses the protruding portions, the bent portion is reciprocated to cause the upright portion of the leaf spring to strike against the inner surface of the side wall of the casing, whereby giving the operator a tactile feel and, at the same time, producing a clicking sound.

DETAILED DESCRIPTION OF THE INVENTION

Figure 1:
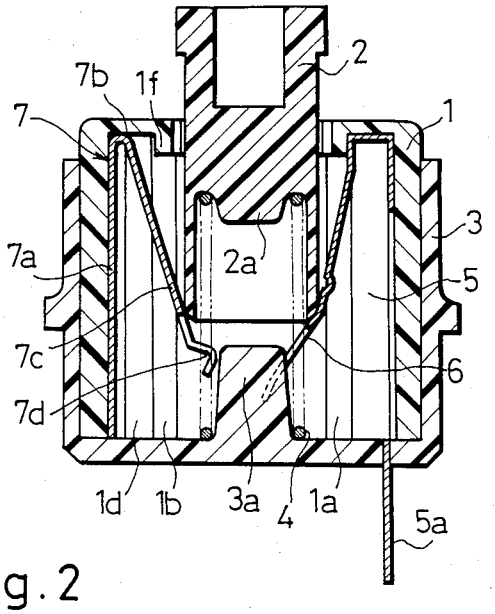
FIG. 1 is a side elevation in cross section of a pushbutton switch according to the present invention, for showing the condition in which the switch is not depressed.

Referring to FIGS. 1–5, there is shown a pushbutton switch embodying the concept of the present invention. This switch includes an upper casing 1 made from a synthetic resin such as PBT (polybutylene terephthalate), a stem 2 made from a synthetic resin such as nylon, a lower casing 3 made from a material similar to the material of the upper casing, a membrane switching device 5, a contact spring 6 made of stainless steel or similar material, and a leaf spring 7 made of stainless steel or similar material.

The condition in which the stem is not depressed is shown in FIG. 1, where the stem 2 has been inserted between step portions 1*a* and 1*b* (see FIG. 5) formed on the upper casing 1. The lower casing 3 and the stem 2 are provided with projections 3*a* and 2*a*, respectively. A coiled spring 4 is mounted between the projections 3*a* and 2*a* such that the stem 2 can reciprocate. The lower casing 3 is mounted to the upper casing 1 using a snap (not shown) after various components are received in the upper casing 1 as described below.

Figure 4:
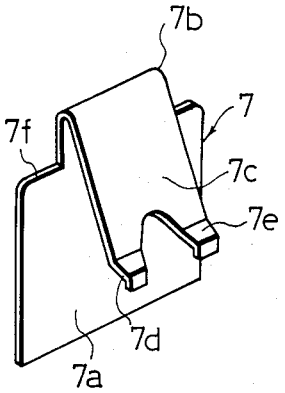
FIG. 4 is a perspective view of the leaf spring shown in FIG. 1.
Figure 5:
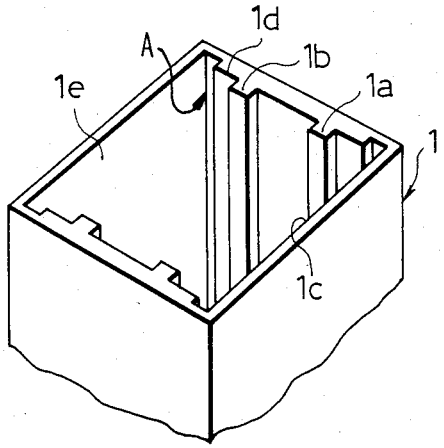
FIG. 5 is a perspective view of the upper casing shown in FIG. 1 as viewed from the lower side of the casing.

The switching device 5 is disposed between the step portion 1*a* of the upper casing 1 and the inner surface 1*c* of a side wall of the casing. The spring 6 is mounted to the device 5 to actuate it when the spring is pressed by the stem 2. The leaf spring 7 is disposed on the opposite side of the stem 2 from the device 5, and comprises an upright portion 7*a* and a spring portion 7*c* for producing a clicking operation, as shown in FIG. 4. Portions of the upright portions 7*a* are bordered by shoulder portions 7*f*, above which a bent portion 7*b* is provided. The spring portion 7*c* extends obliquely downwardly from the bent portion 7*b*.

The lower portion of the spring portion 7*c* is bifurcated, and each lower end of these two separated portions is provided with a protrusion 7*d*. The upright portion 7*a* of the spring 7 is disposed between the step portion 1*d* of the upper casing 1 and the inner surface 1*e* of the side wall. The spring portion 7*c* is disposed on the side of the stem 2 such that the spring portion 7*c* is depressed when the stem 2 is depressed.

Figure 2:
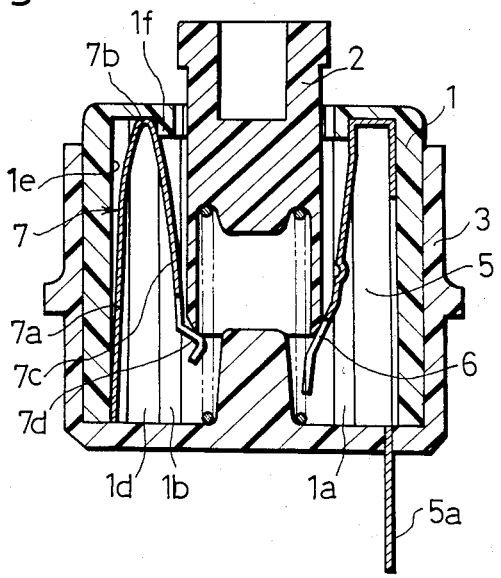
FIG. 2 is a side elevation in cross section of the switch shown in FIG. 1, for showing the condition in which the switch is being depressed.
Figure 3:
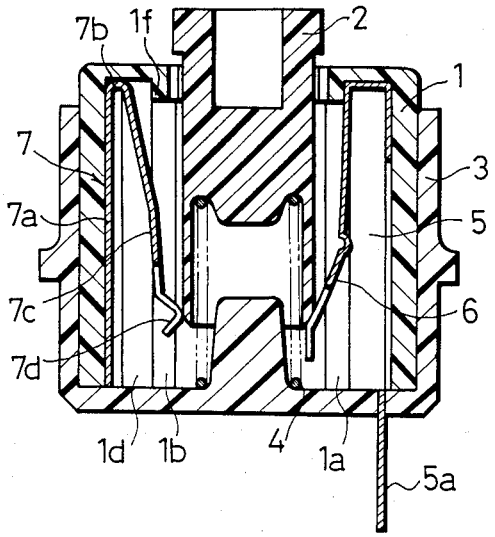
FIG. 3 is a side elevation in cross section of the switch shown in FIG. 1, for showing the condition in which the switch has been fully depressed.

The operation of the novel pushbutton switch constructed as described above is next described by referring to FIGS. 2 and 3; FIG. 2 shows the condition in which the stem 2 is being depressed, and FIG. 3 shows the condition in which the step 2 has been fully depressed.

When the stem 2 is depressed, it pushes inclined surfaces 7*e* on the protruding portion 7*d*, shifting sidewardly (to the right in the drawings) the upright portion 7*a* of the spring 7 toward the stem 2 from the top of the spring 7, i.e., from the vicinity of the bent portion 7*b*. The upright portion 7*a* therefore moves away from the inner surface 1*d* of the side wall of the casing 1. Then, the spring 7 bears on protruding portions 1*f* of the upper casing 1 near the bent portion 7*b*.

At the same time, the spring 6 is depressed, but not sufficiently to actuate the switching device 5. Further depression of the stem 2 causes the stem 2 to ride on the protruding portions 7*d* of the spring 7, as shown in FIG. 3, to give the operator a tactile feel, due to the abrupt transition between the sliding parts. At this time, the stem 2 acts to push the protruding portions 7*d* laterally, urging the leaf spring 7 toward the inner surface 1*e* of the side wall. Then, the upright portion 7*a* of the spring 7 moves back (to the left of the drawings) and strikes on the inner surface 1*e* of the side wall, producing a colliding sound, or a clicking sound. Concurrently, the spring 6 presses against the switching device 5, actuating it. That is, just when the switch is actuated, a tactile feel is given to the operator, and a clicking sound is produced.

When the stem 2 is then released, the coiled spring 4 moves the stem 2 upward, so that the stem 2 disengages from the protruding portions 7*d*. At the same time, the switching device 5 is restored to the off condition. Namely, the device is restored to the condition shown in FIG. 1.

The distance between each step portion 1*d* of the casing 1 and the inner surface 1*e* of the side wall is made larger than the thickness of the leaf spring 7, but the distance can be made equal to the thickness, because the portion of the spring 7 located above the shoulder portions 7*f* is not constrained by the step portions 1*d*, although movement of the portion of the spring 7 lying below the shoulder portions 7*f* is restricted by the step portions 1*d* of the casing 1, as shown in FIG. 4. In any event, the requirement is only that the upper portion of the spring 7 can reciprocate.

Figure 6:
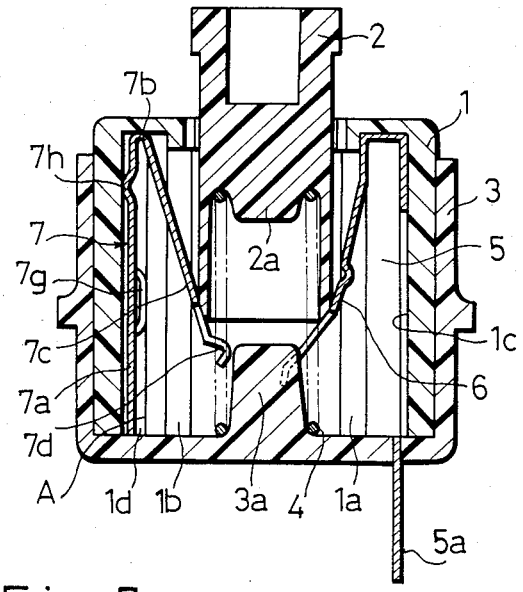
FIG. 6 is a view similar to FIG. 1, but showing another example of a pushbutton switch according to the invention.
Figure 7:
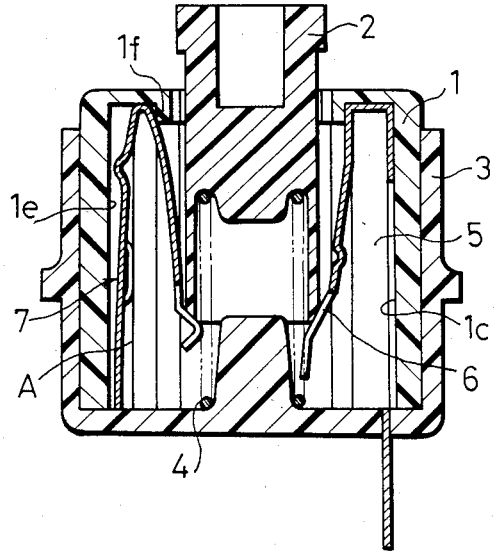
FIG. 7 is a view similar to FIG. 2, but showing the switch of FIG. 6.
Figure 8:
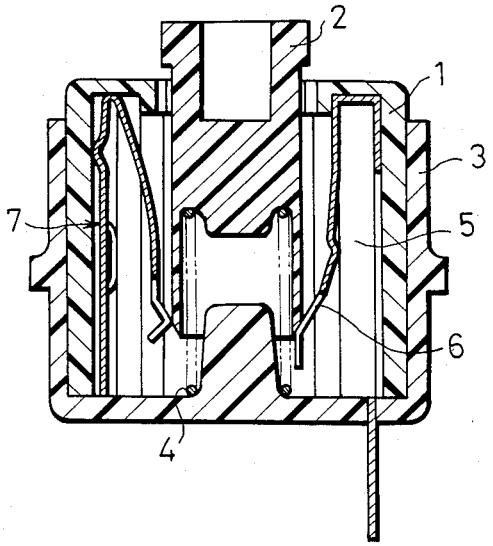
FIG. 8 is a view similar to FIG. 3, but showing the switch of FIG. 6.
Figure 9:
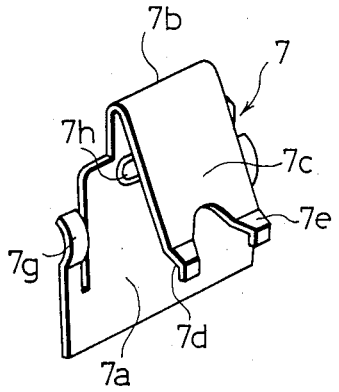
FIG. 9 is a view similar to FIG. 4, but showing the leaf spring shown in FIG. 6.

Referring next to FIGS. 6–9, there is shown another pushbutton switch according to the invention. FIG. 6 shows the condition in which the switch is not depressed. FIG. 7 shows the condition in which it is being depressed. FIG. 8 shows the condition in which it has been fully depressed. The leaf spring of the switch is shown in FIG. 9. This switch is similar to the switch shown in FIG. 1 except for the leaf spring and, therefore, the components other than the spring will not be described below.

The leaf spring 7 is comprised of an upright portion 7*a*, a bent portion 7*b*, and a spring portion 7*c* for producing a clicking operation. The upright portion 7*a* has spring portions 7*g* on its both sides and a protrusion 7*h* that comes into abutting engagement with the inner surface 1*e* of the side wall of the upper casing 1. The spring portion 7*g* engages with a grooved side wall A (indicated in perspective in FIG. 5 and shown in section in FIGS. 6 and 7) of the upper casing 1. The lower portion of the spring portion 7*c* is bifurcated, and each lower end of these two separated portions is provided with a protrusion 7*d*.

In the operation of the pushbutton switch constructed as described in connection with FIGS. 6–9, when the stem 2 is depressed, it pushes inclined surfaces 73 of the protrusions 7*d* to cause the upper portion of the leaf spring 7, i.e., the portion near the bent portion 7*b*, to be thrown toward the stem 2. Thus, the protrusion 7*h* of the spring 7 moves away from the inner surface 1*e* of the upper casing 1, bringing the portion close to the bent portion 7*b* into abutting engagement with the projection 1*f* of the casing 1. At the same time, the contact spring 6 is depressed, but not sufficiently to actuate the switching device 5. Further depression of the stem 2 causes it to ride on the protrusions 7*d*, giving the operator a tactile feel corresponding to the clicking operation. At this time, the stem 2 pushes the protrusion 7*d* laterally. This permits the spring 7 to return to the side of the inner surface 1*e* of the side wall, and then the projection 7*h* of the spring 7 collides with the inner surface 1*e* to produce a colliding sound, or a clicking sound. At the same time, the switching device 5 is depressed by the spring 6, thereby actuating the device. That is, just when the switch is actuated, a tactile feel is given to the operator, and a clicking sound is produced.

Under this condition, if the stem 2 is then released, the coiled spring 4 pushes the stem 2 upward. The stem 2 therefore moves away from the protrusions 7*d*. At the same time, the switching device 5 is driven into the off condition.

While the invention has been particularly shown and described with reference to preferred embodiments thereof, it will be understood by those skilled in the art that various modifications and changes may be made therein without departing from the spirit and scope of the invention. For example, the switching device 5 is depressed by the depression spring 6 in the described examples, but the device may be replaced with an other switching device such as a reed switch. Further, the invention is not limited to a switch using a depression spring. Also, the protrusion 7*h* formed on the leaf spring 7 as shown in FIG. 6 may be replaced by a protrusion formed on the inner surface 1*e* of the side wall of the upper casing 1.

As can be understood from the description thus far made, the novel switch has the bent portion of the leaf spring which is reciprocated to produce a colliding sound when the spring portion of the leaf spring is pressed by the stem. Hence, the switch gives the finger of the operator a tactile feel corresponding to the clicking operation and, at the same time, it can produce a distinct clicking sound. Consequently, the operator can certainly recognize that the switch has been actuated, by means of both the tactile sense and the clicking sound. Thus, a pushbutton switch is provided which is easy to operate, gives less feeling of fatigue, and is excellent from the viewpoint of human engineering.

What is claimed is:

1. A pushbutton switch comprising:

a casing having an opening in an upper wall and side walls;

a pushbutton member having one part extending from said casing and a stem disposed through said opening into said casing, said member being depressable such that an end of said stem is moved downward in the casing from an initial position to an operative position;

biasing means engaging said pushbutton member for biasing said pushbutton member and stem toward said initial position;

a switch element disposed in the casing and having a contact member engaged with the end of said stem such that said switch element is in one state when said stem is in said initial position and another state when said stem is in said operative position; and a leaf spring disposed in the casing adjacent one side wall of said casing, said spring including a fixed portion which is fixedly mounted relative to said one side wall, an upright portion extending therefrom displaceable by a bending action of said spring away from said one side wall and releasable back toward said one side wall so as to strike against it and cause a clicking sound, a bent portion bent downward from said upright portion at an angle, a spring portion extending downward at said angle from said bent portion and provided with a protruding portion on its end, wherein as said stem is moved downward from said initial position, said end of said stem rides downwardly on said spring portion so as to bend said leaf spring and displace said upright portion thereof away from said one side wall, and as said stem reaches said operative position and said switch element is switched from one state to the other, said end of said stem engages said protruding portion, thereby providing an operator of said pushbutton switch a tactile feel of operation, and then rides over said protruding portion so as to release said end of said spring portion and cause said upright portion to move back and strike against said one side wall, thereby providing the operator a clicking sound for aural confirmation of operation.

2. A pushbutton switch according to claim 1, wherein a projection is provided between said upright portion of said leaf spring and said one side wall of said casing for forming a striking surface for causing said clicking sound.

* * * * *